US005653527A

United States Patent [19]

Müessli

[11] Patent Number: 5,653,527

[45] Date of Patent: Aug. 5, 1997

[54] POWER-SAVING LAMP

[76] Inventor: Daniel Müessli, Im Fährich 2, CH-3038 Kirchlindach, Switzerland

[21] Appl. No.: 520,512

[22] Filed: Aug. 29, 1995

[30] Foreign Application Priority Data

Aug. 30, 1994 [CH] Switzerland ..... 02650/94

[51] Int. Cl.[6] ..... H01R 33/00

[52] U.S. Cl. ..... 362/226; 362/216; 362/457; 439/236

[58] Field of Search ..... 439/226, 227, 439/236, 356, 357, 358, 645; 313/318.01, 318.04, 318.11; 362/216, 217, 221–226, 260, 263, 265, 378, 457

[56] References Cited

U.S. PATENT DOCUMENTS

| | | | |
|---|---|---|---|
| 4,570,105 | 2/1986 | Engel | 439/236 |
| 4,750,096 | 6/1988 | Lim | 362/260 |
| 4,841,193 | 6/1989 | Nakamura et al. | 313/318.02 |
| 4,878,159 | 10/1989 | Blaisell et al. | 362/222 |
| 5,015,917 | 5/1991 | Nigg | 362/216 |
| 5,044,974 | 9/1991 | Pelton et al. | 439/236 |

*Primary Examiner*—Alan Cariaso
*Attorney, Agent, or Firm*—Rothwell, Figg, Ernst & Kurz

[57] ABSTRACT

The power-saving lamps generally comprise a screw base with built-in electronics and a lamp body which is connected thereto, is mounted on a lamp stand and has one or more discharge lamps. The screw base (1) is designed with a prismatic body (11) which is connected in one piece to the screw part (2) and has two parallel walls (12, 13) situated opposite one another. In each case one groove (14, 15), which is directed toward the screw part (2) in an axially parallel direction from the top side opposite to the screw part (2) and has an end catch (16, 17), is located in the said parallel walls (12, 13). The lamp stand (3) is designed in the same way as the body (11) and with the same prismatic contour. It is provided with two axially parallel tabs (31, 32) which are congruent with the grooves (14, 15) and have a latching lug (33, 34). A sliding sleeve (4) is provided, which has a cavity which is congruent with the contour of the body (11) and with the lamp stand (3) and, having been pushed over the body (11) and the lamp stand (3), retains the tabs (31, 32) with the latching lugs (33, 34) in the groove (14, 15) and the end catch (16, 17). The discharge lamp can thus be exchanged using the same connection base, with the result that reusable electronic components do not also have to be included in the event of disposal.

1 Claim, 3 Drawing Sheets

4

4

1

4

1
15
17
19
18
18
16

17
15
2
1

POWER-SAVING LAMP

The present invention relates to a power-saving lamp in accordance with the preamble of the independent claim 1, which comprises a connection base with built-in electronics and a lamp body which is connected thereto, is mounted on a lamp stand and has one or more discharge lamps. The term connection base includes not only screw bases having an Edison thread but also those having a miniature thread or a bayonet catch.

Power-saving lamps are generally constructed in such a manner that they can be handled by a user in the same way as the ubiquitously well-known incandescent lamps having an Edison thread. For this purpose, the discharge lamp is constructed, during production, on a connection base provided with the Edison thread. The base then contains the electronic components, such as rectifier, filter stage, oscillation build-up circuit and high-frequency generator. Such circuits are known, therefore, for example, DE-A-3611611 describes a circuit arrangement for the high-frequency operation of a low-pressure discharge lamp, in which circuit arrangement such an arrangement is explained.

It will be obvious to anybody skilled in the art that even though such a discharge lamp may have a burning life of up to 8000 hours during normal operation, the electronic circuit arrangement can in fact endure this operating life many times over. In other words, since nowadays more and more emphasis is being attached to recycling, no functional components should have to be discarded.

Accordingly, one object of the invention is to provide a power-saving lamp in which the electronic section can be used many times.

According to the invention this is achieved in accordance with the features in the characterizing part of the independent claim 1 by the fact that the screw base is designed with a prismatic body which is connected in one piece to the screw part and has two parallel walls situated opposite one another, that in each case one groove, which is directed toward the screw part in an axially parallel direction from the top side opposite to the screw part and has an end catch, is arranged, at least over part of the entire height of the body, in the said parallel walls, that the lamp stand is further designed, in the same way as the body, with the same prismatic contour, that it is provided with two axially parallel tabs which are congruent with the grooves and have a latching lug, and that a sliding sleeve is provided, which has a cavity which is congruent with the contour of the body and with the lamp stand and, having been pushed over the body and the lamp stand, retains the tabs with the latching lugs in the groove and the end catch.

Figure 3:
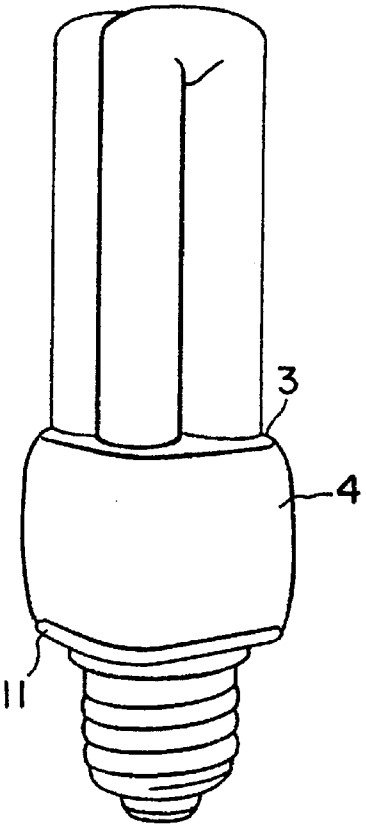
Figure 2:
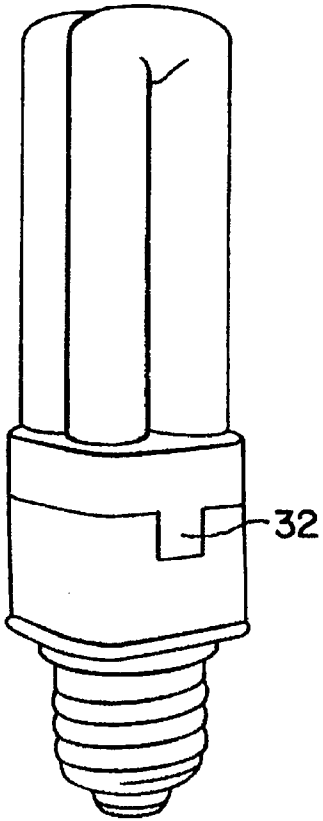
Figure 1:
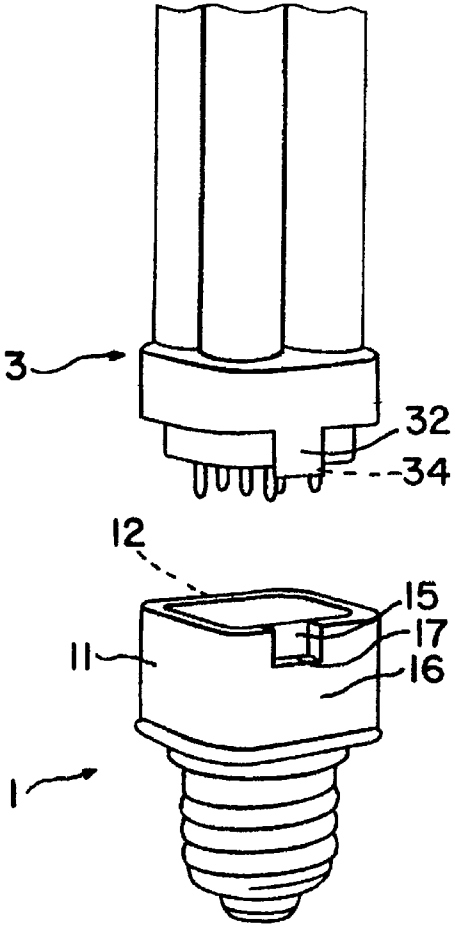
Figures 4A, 4B, 4C, 5A, 5B, 5C:
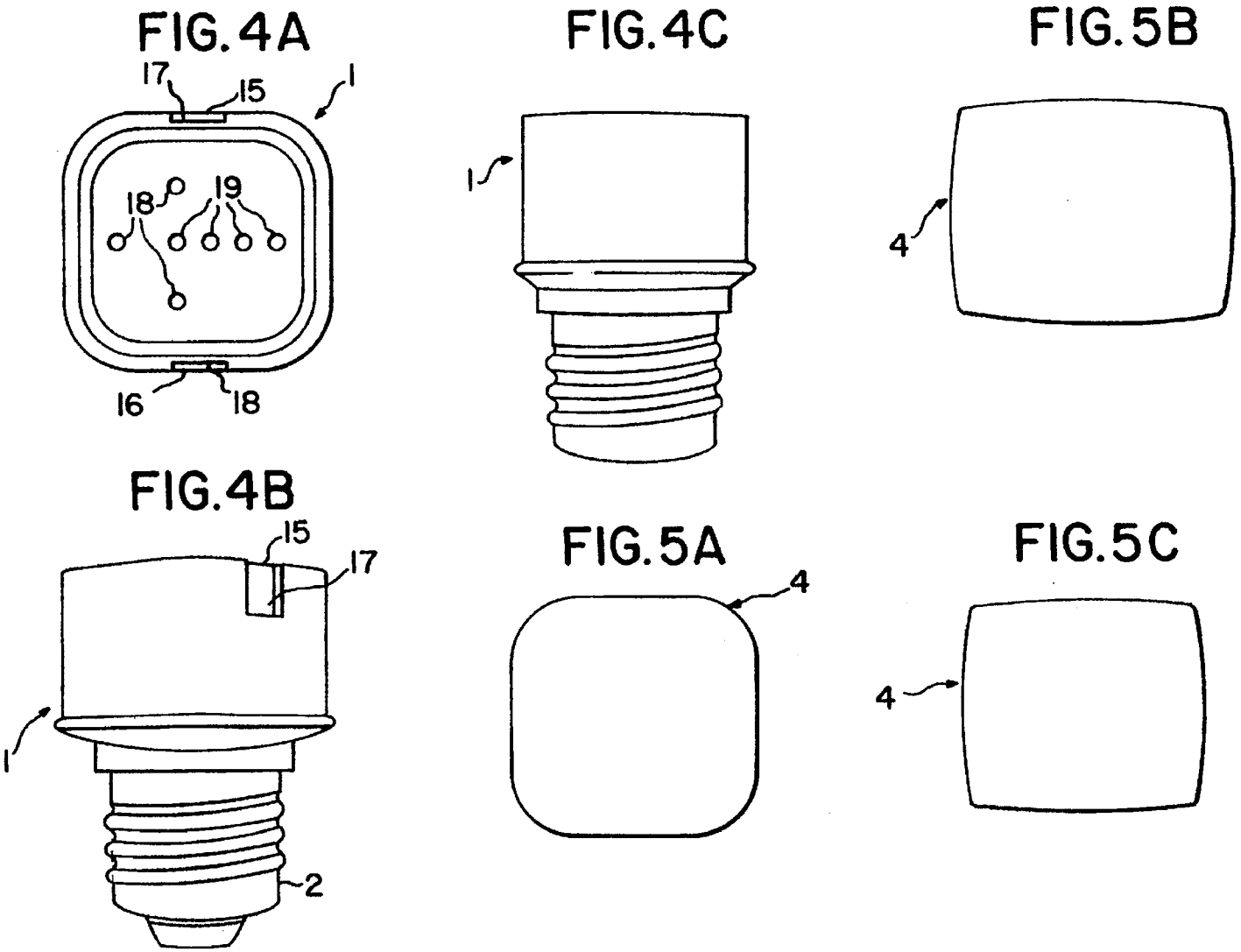
Figure 6C:
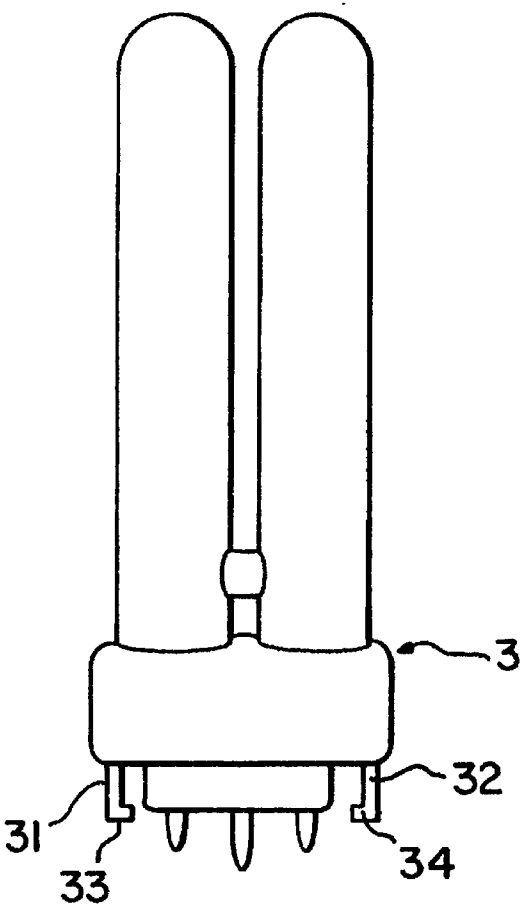
Figure 6B:
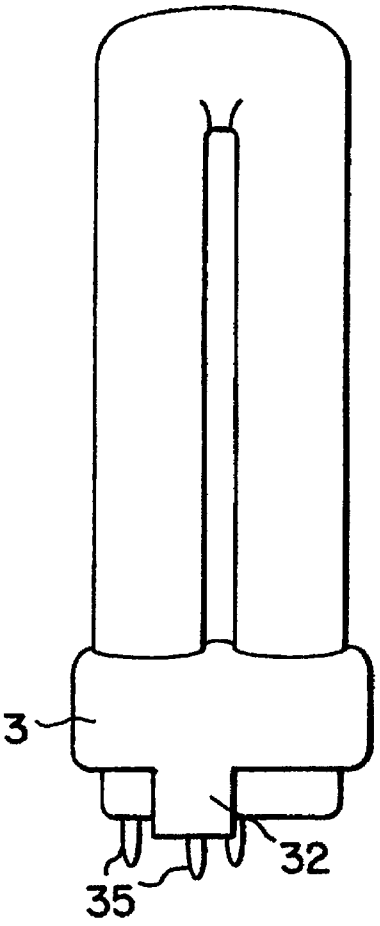
Figure 6A:
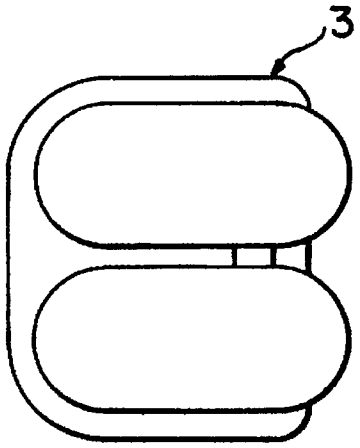

Exemplary embodiments of the invention are explained below with reference to the drawings, in which:

FIG. 1 shows a perspective view of a lamp base and of a discharge lamp at a distance therefrom, FIG. 2 shows a perspective view identical to FIG. 1 with the discharge lamp inserted into the lamp base, FIG. 3 shows the same perspective illustration as in FIG. 2 with a sleeve for the mechanically rigid connection of the lamp base and the discharge lamp, FIGS. 4*a–c* show the lamp base on its own in three different views, FIGS. 5*a–c* show the sleeve on its own in three different views, and FIGS. 6*a–c* show the discharge lamp on its own in three different views.

The discharge lamp is constructed in a known manner on a lamp base 3. In a conventional design, it comprises a single or a double glass body, depending on whether it is a 5, 7, 11 or 20 watt lamp. As is evident in FIGS. 1, 6*b* and 6*c*, the base 3 has axially parallel, downwardly projecting tabs 31, 32 having latching lugs 33, 34. These tabs are designed to be aligned with the outer wall of the base 3 and the latching lugs 33, 34 are directed toward one another.

The mating element and the grooves 15, 16 having end catches 17, 18 are located in the screw base 1, to be precise in the base part 11. They are arranged on two opposite walls of this base part 11 and run axially parallel to the main axis of the arrangement. It will be plausible that this type of lamp base 3 together with the discharge lamp can be configured to be exchangeable.

It is, of course, obvious that the lamp base must be provided with plug pins 35 and the screw base 1 must be provided with corresponding sockets 18. The lamp part can be separated from the base part in this way. It is now possible to make a tap in the electronics for any currently conventional power of the lamps, with the result that, for example, four sockets 19 can be used to select the respectively correct power matching. The lamp manufacturer then only needs to place the respective pin correctly on the lamp base in order to ensure that the discharge lamp is correctly supplied.

Consequently, the user can insert any desired lamp such that if an excessively low-power light output was initially provided, he can insert a discharge lamp having a higher-power light output into the same base without any problems.

It now remains only to ensure that the screw base 1 and lamp base 3 are assembled in a mechanically robust manner, so that the lamp cannot be separated inadvertently from the screw base simply by pulling.

For this purpose, a sliding sleeve 4 in accordance with FIGS. 5*a–c* is provided, which is pushed over the lamp stand 3 and the base 11 and ensures that the tabs 31, 32 with their latching lugs 33, 34 of the lamp base 3 remain inserted in the grooves 15, 16 with the end catches 17, 18 of the prismatic body 11. The two parts, namely the prismatic body 11 and the lamp, can thus be regarded as one piece.

A further advantage of this sliding sleeve is that it can be decorated. Thus, it would be conceivable that it can be used, having been provided with a reflector screen, as a directed spotlight, for example. It may also be imagined that this sliding sleeve may be provided with a spherical body, may completely encapsulate the discharge lamp and thus mask the technical impression caused by the arrangement and the form of the discharge tubes, and hence represent an esthetic form.

I claim:

1. A power-saving lamp assembly comprising a screw base with built-in electronics and a lamp body which is connected thereto, said lamp body comprising a lamp base and one or more discharge lamps attached to said lamp base, wherein the screw base comprises a prismatic body and a screw part attached to and extending from said prismatic body, said prismatic body including two generally opposing walls, wherein each of said generally opposing walls has a groove extending axially from a top side of said wall toward the screw part over at least part of the entire height of the prismatic body, each of said grooves having an end catch, wherein the lamp base has generally the same prismatic contour as said prismatic body and has two axially extending tabs which are congruent with the grooves, each of said tabs having a latching lug which engages one of said end catches, said lamp assembly further comprising a sliding sleeve which has a cavity that is generally congruent with the contour of the prismatic body and the lamp base, said sliding sleeve, having been pushed over the prismatic body and the lamp base, retaining the tabs and the latching lugs in the grooves and the end catches, respectively.

* * * * *